US005186207A

United States Patent [19]

Kaneko et al.

[11] Patent Number: 5,186,207

[45] Date of Patent: Feb. 16, 1993

[54] SMALL-CAPACITY EXPANSION VALVE

[75] Inventors: Morio Kaneko; Kazushige Tajima, both of Saitama, Japan

[73] Assignee: Kabushiki Kaisha Saginomiya Seisakusho, Tokyo, Japan

[21] Appl. No.: 800,553

[22] Filed: Dec. 5, 1991

[30] Foreign Application Priority Data

Aug. 9, 1991 [JP] Japan ..... 3-200458

[51] Int. Cl.[5] ..... F16K 31/126

[52] U.S. Cl. ..... 137/495; 137/510; 236/92 B; 251/75

[58] Field of Search ..... 137/494, 495, 510, 524; 236/92 B; 251/337, 61.4, 75

[56] References Cited

U.S. PATENT DOCUMENTS 2,452,441 10/1948 Dube ..... 236/92 B X
2,506,413 5/1950 Dube ..... 236/92 B
2,533,600 12/1950 Matteson ..... 236/92 B X
2,548,324 4/1951 Smith ..... 251/75 X
3,388,864 6/1968 Noakes ..... 236/92 B
4,632,305 12/1986 Fujiwara ..... 236/92 B
4,678,007 7/1987 Ransom et al. ..... 251/75 X
4,959,973 10/1990 Tanaka et al. ..... 236/92 B X

*Primary Examiner*—Stephen M. Hepperle
*Attorney, Agent, or Firm*—Lowe, Price, LeBlanc & Becker

[57] ABSTRACT

The expansion valve has an operating pressure setting member that can adjust the operating pressure of a pressure-activated diaphragm by moving a spring retainer of an operating spring against the force the spring which is interposed between the diaphragm and the spring retainer. The operating pressure setting member, after being set at a desired setting position, is securely fitted into and crimped by a secondary coolant flow pipe. The operating pressure setting member has a coolant passage for the coolant to pass through. This construction can completely prevent leakage of the coolant from the operating pressure setting member as would occur with conventional expansion valves whose operating pressure setting member is not installed inside the secondary coolant flow pipe.

6 Claims, 5 Drawing Sheets (PRIOR ART)

SMALL-CAPACITY EXPANSION VALVE

BACKGROUND OF THE INVENTION

1. Field of the Invention

The present invention relates to a small-capacity expansion valve used in small refrigerators to control a coolant flow.

2. Description of the Prior Art

Small refrigerating equipment incorporated in home refrigerators and automatic vending machines have a very small amount of cooling medium and hence often use a capillary as an expansion device. However, the capillary has a drawback of being unable to quickly respond to load changes.

When an expansion valve is used instead of the capillary, it is required to have a small capacity which matches that of the small refrigerating equipment and also have high reliability. For this end, it is necessary to significantly improve the machining precision of the needle valve disc and seat and to construct the valve so that the contact pressure between the valve disc and the valve seat will not become excessively large.

Under these situations, conventional expansion valves with a capacity suitable for small refrigerating equipment have a construction in which a valve disc is provided slidable in a primary chamber and urged by a small valve spring to close an opening in the valve seat provided in a separating wall between the primary and secondary chambers, and in which a communication rod that passes through the valve seat from the secondary side to push the valve disc toward the valve opening direction is connected to a pressure-activated mechanism.

FIG. 7 shows the construction of the above-mentioned prior art. A valve seat d is provided between a primary chamber b and a secondary chamber c in the expansion valve body a. A needle valve disc e that is brought into and out of contact with the valve seat d is installed in the primary chamber b and urged by a valve spring f to close the valve.

In the upper part of the valve body a is provided a pressure chamber h which is defined by a diaphragm g that acts as a pressure-activated member. A heat sensing tube (not shown) is connected to the pressure chamber h through capillary tube i. The operation of the diaphragm g in response to pressure changes in the pressure chamber h is transmitted to the needle valve disc e by a communication rod k that is connected to a contact plate j and passes through the valve opening I. Denoted m is an operating spring that opposes the pressure in the pressure chamber h and is installed between the contact plate j and a movable spring retainer n.

The valve body a is formed with an inclined adjust cylinder o in which an operating spring adjust screw p is installed so that it can be advanced and retracted. A front end surface $p_1$ of the operating spring adjust screw p is in contact with a tapered driven surface $n_1$ of the spring retainer n. Designated g is a seal ring and r a cap.

In the above construction, as the spring adjust screw p is advanced or retracted, the spring retainer n is moved up or down to change the compressive force of the operating spring m and thereby adjust the operating pressure of the diaphragm g.

SUMMARY OF THE INVENTION

In the above-mentioned conventional expansion valves, since the adjust cylinder o communicates with the secondary chamber c in the valve body a through an internal pressure equalizing communication hole z, deterioration of the seal ring g will very likely lead to leakage of the coolant. Particularly with small refrigerating equipment which have only a small amount of coolant sealed, any leakage of the coolant even in minute amounts cannot be tolerated.

To overcome this problem, the present invention provides an expansion valve which can completely prevent coolant leakage.

To achieve the above objective, the present invention provides an expansion valve which comprises: a primary chamber and a secondary chamber formed in a valve body; a valve seat in the valve body provided in a separating wall between the primary and secondary chambers; a valve disc driven toward or away from the valve seat to cooperate with it to regulate the flow in the valve; a pressure-activated diaphragm for operating the valve disc; an operating spring that determines an operating pressure of the diaphragm; a spring retainer movably installed in the valve body for holding the operating spring between it and the pressure-activated diaphragm; and an operating pressure setting member for moving the spring retainer against the force of the operating spring, said operating pressure setting member being fixed at a desired setting position in a coolant flow pipe connected to the valve body.

In the coolant flow pipe, the operating pressure setting member is adjusted in the axial direction of the pipe to directly or indirectly move the spring retainer to make a desired setting of the operating pressure for the diaphragm. With the setting done in this way, the operating pressure setting member is securely fixed to the coolant flow pipe.

DETAILED DESCRIPTION OF PREFERRED EMBODIMENTS

Figure 1:
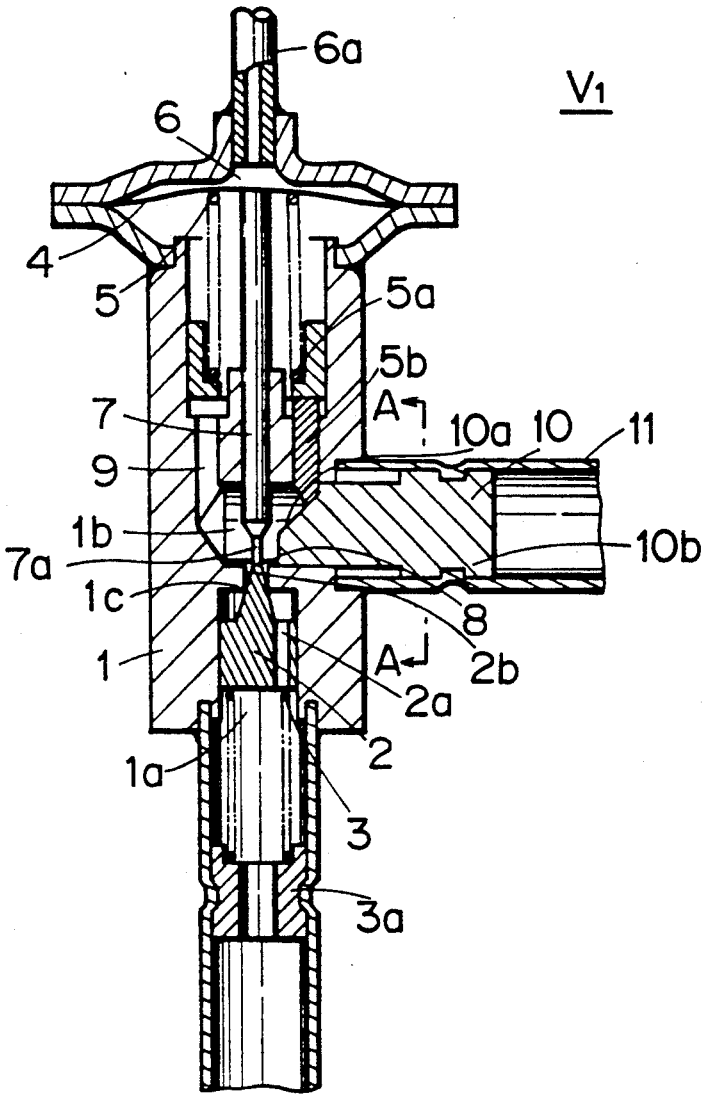
FIG. 1 is a cross section of a thermal type expansion valve as one embodiment of this invention.

FIG. 1 shows a thermal type expansion valve $V_1$ as a first embodiment of this invention. In the figure, reference numeral 1 represents a valve body, in which is contained a valve seat 1*c* provided in a separating wall between a primary chamber 1*a* and a secondary chamber 1*b*. A valve disc 2 with one end pointed as a needle portion 2*b* is loosely installed in the primary chamber 1*a* and urged toward the valve seat 1*c* by a valve spring 3 interposed between the valve disc 2 and a spring retainer 3*a*.

Designated 4 is a diaphragm supported by an operating spring 5. When applied with a pressure in a pressure chamber 6, which communicates with a heat sensing tube (not shown) through a capillary tube 6*a*, the diaphragm 4 drives a communication rod 7. The communication rod 7 has its end 7*a* formed small in diameter to such an extent that it can pass through the valve seat 1*c* while leaving a gap 8 in the seat for the coolant to pass through. The end 7*a* of the communication rod 7 thus can contact and push the upper end of the valve disc 2. The motion of the diaphragm 4 therefore is transmitted through the communication rod 7 to the valve disc 2, thereby controlling the valve opening. Denoted 9 is a pressure equalizing hole for introducing the pressure of the secondary chamber 1*b* to the underside of the diaphragm 4.

Figure 2:
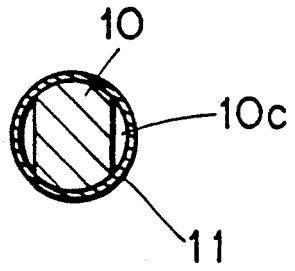
FIG. 2 is a cross section taken along the line A—A of FIG. 1.

The compressive force of the operating spring 5 can be changed by adjusting an operating pressure setting member 10. The operating pressure setting member 10 has a tapered drive surface 10*a* at the end which, when the setting member 10 is advanced or retracted, causes, via an adjust rod 5*b*, a spring retainer 5*a* to move up or down, resulting in a change in the compression force of the operating spring 5. When the operating pressure setting member 10 is set at a desired position, it is then fixed to a secondary pipe 11—which forms a part of the coolant flow pipe—by crimping the secondary pipe 11 onto a recessed part 10*b* of the operating pressure setting member 10. Now, the operating pressure of the diaphragm 4 is completely set. The operating pressure setting member 10 is a round bar with the opposing circumferential surfaces cut away, as shown in FIG. 2, to form a coolant flow gap 10*c* between the secondary pipe 11 and itself.

Figure 3:
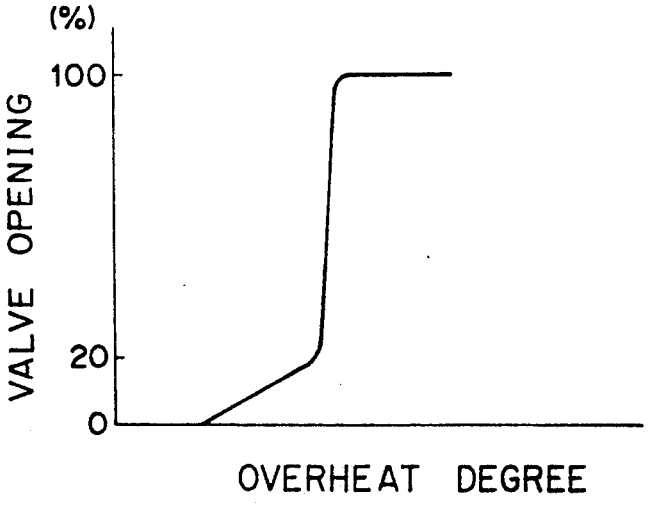
FIG. 3 is a graph showing the operation characteristic of the thermal type expansion valve of the invention.

The diaphragm 4 in the expansion valve $V_1$ has a snap-action characteristic. When the pressure difference between the pressure chamber 6 and the secondary chamber 1*c* plus the working load of the operating spring 5 exceeds a predetermined value, the diaphragm 4 snaps or collapses to cause the valve disc 2 to part completely from the valve seat 1*c*. At this time, the coolant passage gap 8 works as a throttle to limit the flow of coolant, providing the function of the expansion device that handles a large coolant flow. However, until after the pressure difference between the pressure chamber 6 and the secondary chamber 1*b* plus the working load of the operating spring 5 reaches the predetermined value, the diaphragm 4 continuously moves according to changes in the pressure difference to slightly compress the operating spring 5 and thereby float the valve disc 2 from the valve seat 1*c*, offering the normal proportional control function of the expansion device that handles a small coolant flow. An example of the valve operation characteristic is shown in FIG. 3, which indicates the relationship between the overheat degree of the coolant gas on the suction side of a compressor and the valve opening.

The valve disc 2 has a coolant passage hole 2*a* formed therethrough at an eccentric position so that the coolant flowing through the eccentric hole 2*a* presses the valve disc 2 against the inner wall of the valve body I on the opposite side, preventing the valve hunting.

The expansion valve must have a small capacity that matches that of a small refrigerator and still have high reliability. This requires the valve seat 1*c* and the needle valve disc 2*b* to be formed with a substantially improved precision, and the expansion valve should also be constructed so that the contact pressure of the valve disc 2 against the valve seat 1*c* will not become excessively large. To meet these requirements, it is general practice to use a spring with a relatively small elasticity as the valve spring 3. In this case, vortices generated when the coolant flows through the primary chamber tend to cause the valve disc to vibrate, producing noise.

However, since the valve disc has the eccentric coolant passage hole 2*a*, the coolant as it passes through the eccentric hole 2*a* generates a dynamic force, which is non-symmetrical with respect to the center axis of the valve disc and hence presses the valve disc 2 lightly against the opposite side wall of the primary chamber 1*a*, so that the valve disc 2 will not vibrate in the primary chamber if the strength of the valve spring 3 is weak.

In addition to the normal control operation similar to the one performed by common thermal type expansion valves, this expansion valve $V_1$ performs the following important function. When the overheat degree of the coolant gas increases as a result of, for example, an increased heat load in the refrigerating circuit, this anomaly is detected by the heat sensing tube attached to the suction side of the coolant compressor and the resulting snapping action of the diaphragm causes the valve disc to move to the fully open position, allowing the maximum amount of coolant determined by the throttling mechanism to flow through the valve. Then, when the coolant gas returns to the normal overheat degree, the valve disc is recovered to the normal control operation by the diaphragm's snap action.

When incorporated in a refrigeration circuit of a home refrigerator and the like, the thermal type expansion valve $V_1$ described above operates as follows. Each time the compressor is turned on, a highly overheated coolant gas returning to the compressor is detected at the suction side of the compressor to automatically shift the valve disc to the fully open position to increase the coolant flow, thereby removing trapped foreign substances or dirt from the valve seat. When dirt clogs the valve, the flow of coolant generally decreases, resulting in an imbalance between the heat load and the coolant flow. In such a case, the thermal type expansion valve of this invention detects an increase in the overheat degree of the returning coolant gas and operates as mentioned above to automatically remove trapped dirt before returning to the normal control action.

Figure 4:
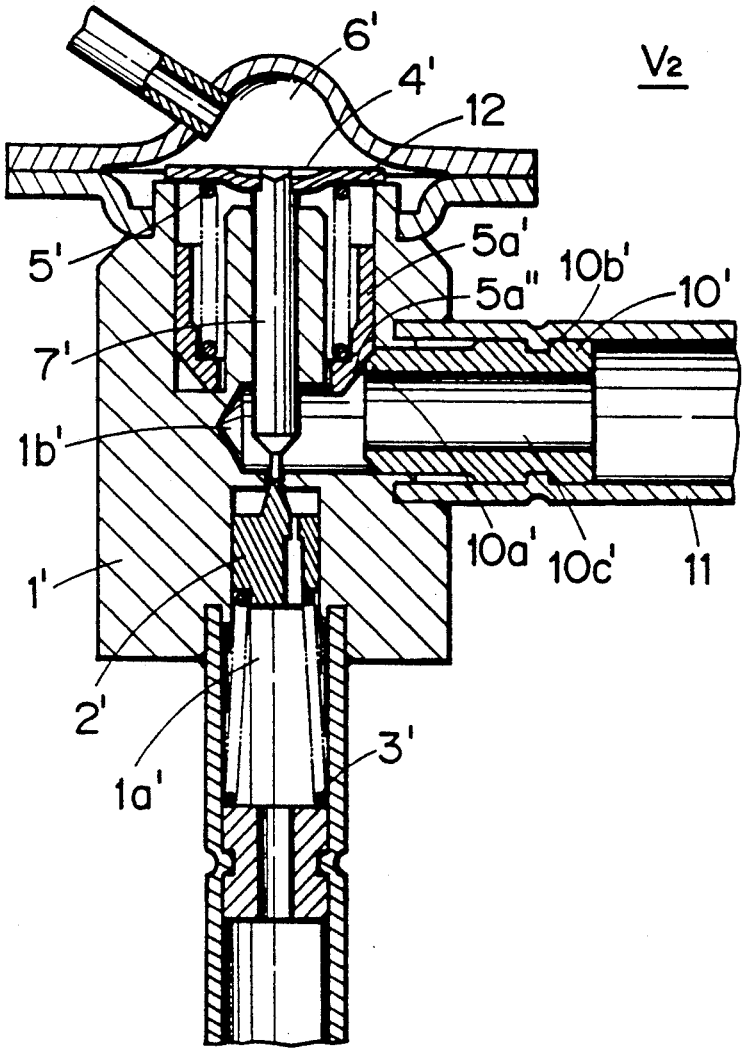
FIG. 4 is a cross section of another embodiment of the thermal type expansion valve according to the invention.

FIG. 4 shows a second embodiment of the thermal type expansion valve $V_2$. In the figure, an operating spring 5' is interposed between a contact plate 12 of the diaphragm 4' and a spring retainer 5*a'*, which is slidably installed in the valve body 1'. A tapered driven surface 5*a''* of the spring retainer 5*a'* facing the secondary chamber 1*b'* is brought into direct contact with a tapered drive surface 10*a'* of the operating pressure setting member 10', which is installed in the secondary pipe 11 that forms a part of the coolant flow pipe. As in the first embodiment, the operating pressure setting member 10' positioned at a desired point is securely fixed to the secondary pipe 11 by crimping the pipe 11 over the recessed portion 10*b'* of the member 10'. The operating pressure setting member 10' is formed with a coolant flow gap 10*c'*. Designated 1*a'* is a primary chamber, 2' a needle valve disc, 3' a valve spring, 6' a pressure chamber, and 7' a communication rod.

Figure 5:
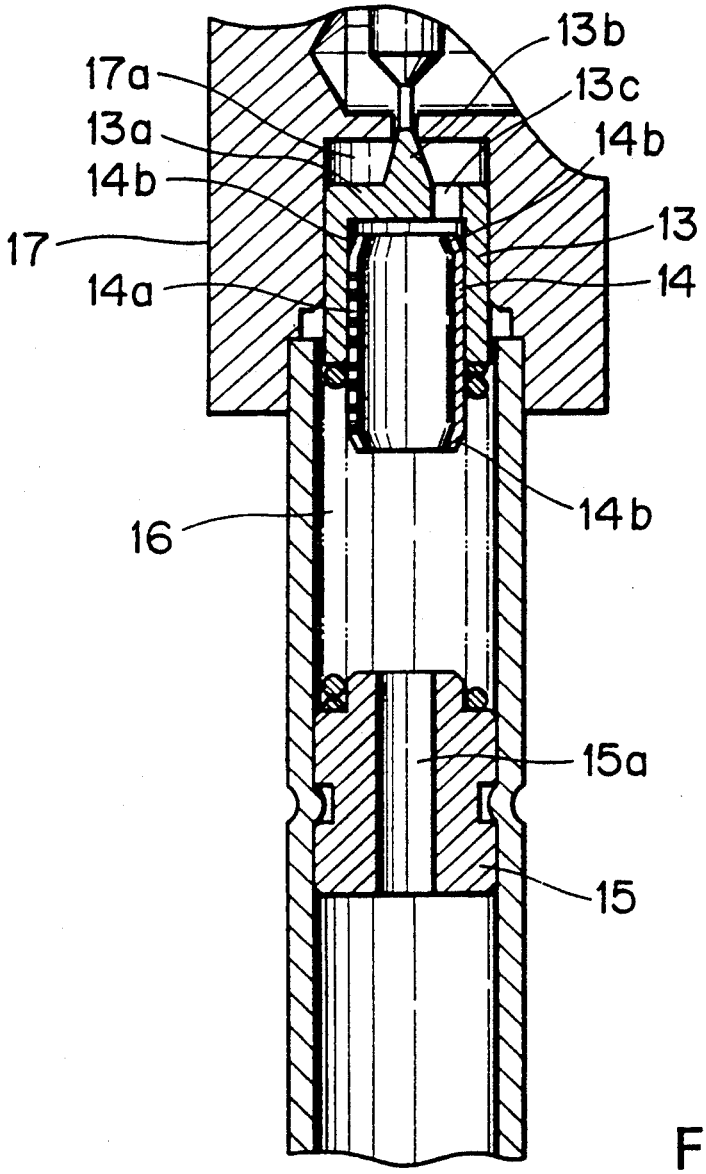
FIG. 5 is a cross section showing another embodiment of a valve disc vibration prevention mechanism.
Figure 6:
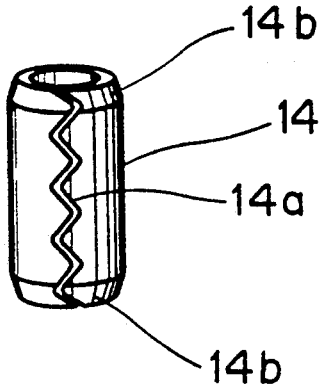
FIG. 6 is a perspective view of a flow stabilizing cylinder of FIG. 5.
Figure 7:
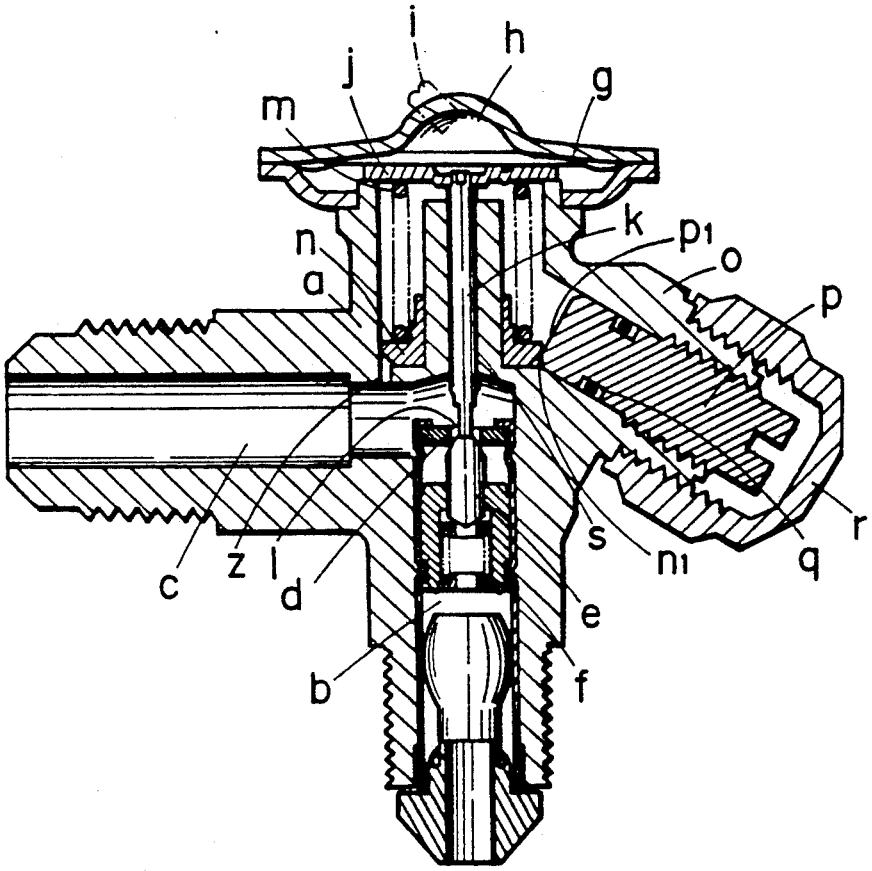
FIG. 7 is a cross section of a conventional, thermal type expansion valve.

FIG. 5 shows another embodiment of a valve disc vibration preventing structure. In this example, the valve disc 13 is formed cylindrical (4.5 mm in diameter) and has a needle portion 13*b* projected from the center of a top end portion 13*a* thereof. The valve disc 13 also has a coolant passage hole 13*c* (0.8 mm in diameter) formed therethrough at an eccentric position outside the needle portion 13*b*. A flow stabilizing cylinder 14 formed with a splitting groove 14*a* is fitted under pressure into the cylindrical valve disc 13 with the splitting groove 14*a* shifted 180 degrees out of phase with the coolant passage hole 13*c*. The flow stabilizing cylinder 14 forms a coolant flow passage (0.5 mm in diameter) between its inner end portion 14*b* and the top end portion 13*a*. A coil spring 16 is interposed between the valve disc 13 around the flow stabilizing cylinder 14 and the spring retainer 15 that has a flow passage 15*a*. The flow stabilizing cylinder 14 is formed at each end with an inwardly tapered, narrow-diameter portion 14*b* that facilitates its insertion into the valve disc 13 and engagement with the coil spring 10.

In the above construction, when the coolant entering into the primary chamber 17*a* of the valve body 17 from the flow passage 15*a* of the spring retainer 15 flows through the inside of the coil spring 16, it becomes disturbed and unstable by the spiraling turns of the spring 16. However, the flow is stabilized by the flow stabilizing cylinder 14 as it passes through the cylinder, before entering the coolant passage hole 13*c*, so that the valve disc 13 is prevented from vibrating.

The features and advantages of this invention may be summarized as follows. The diaphragm as a pressure-activated member drives the valve disc toward or away from the valve seat provided in the separating wall between the primary and secondary chambers in the valve body. The operating spring is interposed between the diaphragm and the spring retainer, which is slidably installed in the valve body. In the coolant pipe connected to the valve body, the operating pressure setting member that moves the spring retainer against the force of the operating spring is fixed at a desired setting position. This construction can completely prevent leakage of the coolant from the operating pressure adjust mechanism.

What is claimed is:

1. A small-capacity expansion valve for use in a small refrigerating system such as a home refrigerator or automatic vending machine, comprising:

a primary chamber and a secondary chamber formed in a valve body;

a separating wall in the valve body between the primary and secondary chambers, with a valve seat provided therein;

a valve disc installed in the valve body to be slidably driven toward or away from the valve seat to cooperate with it to regulate a flow in the valve;

a pressure-activated diaphragm for operating the valve disc;

an operating spring for setting an operating pressure of the diaphragm;

a spring retainer movably installed in the valve body for holding the operating spring between it and the pressure-activated diaphragm; and an operating pressure setting member for moving the spring retainer against the force of the operating spring, said operating pressure setting member being provided at a peripheral surface with a recess and being fixed at a selected setting position in a coolant flow pipe connected to the valve body by crimping of the flow pipe into engagement with said recess.

2. The small-capacity expansion valve according to claim 1, further comprising:

a valve spring installed in the primary chamber of the valve body for urging the valve disc toward a valve closing direction;

a communication rod passing through the valve seat from the secondary chamber side to push the valve disc toward a valve opening direction, said communication rod being connected to a pressure-activated mechanism, said pressure-activated mechanism incorporating the diaphragm with a snap-action characteristic in such a way that the operating pressure of the diaphragm can be adjusted; and a throttle mechanism which functions as a large-flow expansion device when the valve is opened to more than a specified opening degree.

3. The small-capacity expansion valve according to claim 1, wherein:

said valve disc has a fluid passage formed axially therethrough at a position which is offset with respect to a central axis of the valve disc.

4. The small-capacity expansion valve according to claim 1, wherein:

said valve disc is a cylindrical valve disc which has a coolant passage hole formed therethrough at an eccentric position in a top end portion thereof, and comprises a flow stabilizing cylinder fitted under pressure into the cylindrical valve disc with said valve spring interposed between the spring retainer and an outer circumferential portion of the flow stabilizing cylinder.

5. A small-capacity expansion valve for use in a small refrigerating system such as a home refrigerator or automatic vending machine, which comprises:

a valve body, having a primary chamber and a secondary chamber formed therein;

a valve seat in the valve body, provided in a separating wall between the primary and secondary chambers;

a valve disc, driven toward or away from the valve seat to cooperate therewith to control a coolant flow in the valve;

a valve spring, installed in the primary chamber for urging the valve disc toward a valve closing direction;

a pressure-activated mechanism incorporating a pressure-activated diaphragm with a snap-action characteristic, said diaphragm being operated in two steps including a normal continuous step and a large coolant flow step;

a communication rod, connected to the pressure-activated mechanism and extending through the valve seat from the secondary chamber side to push the valve disc toward the valve opening direction; and operating spring means for determining an operating pressure of the diaphragm, whereby the diaphragm is continuously moved in the normal continuous step according to changes in a pressure difference on the diaphragm due to respective pressures applied from a capillary tube side and from the secondary chamber side to push the valve disc toward the valve opening direction, and whereby, when the pressure difference exceeds a predetermined value, the diaphragm snaps into the large coolant flow step, pushing the valve disc to a fully open position to allow a maximum amount of the coolant to flow through the valve, with the valve seat functioning as a throttling mechanism.

6. The small-capacity expansion valve according to claim 5, wherein:

the operating spring means comprises an operating spring and a spring retainer that holds the operating spring between it and the pressure-activated diaphragm, and further comprises an operating pressure setting member for moving the spring retainer against the force of the operating spring, said operating pressure setting member being provided on a peripheral surface with a recess and being fixed at a selected setting position in a coolant flow pipe connected to the valve body by crimping of a part of the flow pipe onto the recess.

* * * * *